US007766308B2

(12) United States Patent
Kochan et al.

(10) Patent No.: US 7,766,308 B2
(45) Date of Patent: Aug. 3, 2010

(54) THEATER RIGGING SYSTEM

(75) Inventors: Stephen J. Kochan, Skaneateles, NY (US); Peter V. Svitavsky, Port Byron, NY (US); Thomas J. Walsh, III, Auburn, NY (US); Thomas S. Young, Jamesville, NY (US)

(73) Assignee: J. R. Clancy, Inc., Syracuse, NY (US)

( * ) Notice: Subject to any disclaimer, the term of this patent is extended or adjusted under 35 U.S.C. 154(b) by 0 days.

(21) Appl. No.: 12/368,774

(22) Filed: Feb. 10, 2009

(65) Prior Publication Data

US 2009/0140221 A1 Jun. 4, 2009

Related U.S. Application Data

(62) Division of application No. 10/906,348, filed on Feb. 15, 2005, now Pat. No. 7,562,863.

(60) Provisional application No. 60/608,811, filed on Sep. 10, 2004.

(51) Int. Cl.
*B66D 3/08* (2006.01)

(52) U.S. Cl. ..... 254/394; 254/331; 254/388; 254/413; 242/602.1

(58) Field of Classification Search ..... 254/393, 254/394, 331, 388, 413; 160/331, 344, 143; 242/609.1, 609.2, 118.41
See application file for complete search history.

(56) References Cited

U.S. PATENT DOCUMENTS

| | | | |
|---|---|---|---|
| 1,739,881 | A | 12/1929 | Wermine |
| 2,942,879 | A | 6/1960 | Izenour |
| 3,024,001 | A | 3/1962 | Worden et al. |
| 3,536,275 | A | 10/1970 | Salomon |
| 3,970,268 | A | 7/1976 | Sheetz |
| 4,087,060 | A | 5/1978 | Laky et al. |
| 4,199,133 | A | 4/1980 | Gagnon et al. |
| 4,324,386 | A | 4/1982 | Gagnon et al. |
| 5,106,057 | A | 4/1992 | Feller et al. |
| 5,141,085 | A | 8/1992 | McCormick |

(Continued)

FOREIGN PATENT DOCUMENTS

| | | |
|---|---|---|
| DE | 3737612 | 6/1989 |

(Continued)

*Primary Examiner*—Evan H Langdon
(74) *Attorney, Agent, or Firm*—George R. McGuire; David B. Woycechowsky; Bond Schoeneck & King, PLLC

(57) ABSTRACT

A theater rigging assembly having a beam, which is attached to structural support members of a theater or other performing arts venue. The assembly further includes a winch assembly and head block that can be positioned at any point along the beam and selectively fixed in position. The winch portion includes cables for raising and lowering battens or other loads. The head block includes head sheaves, which redirect the cables to loft sheaves that are selectively attached to the beam. The head sheaves are diagonally displaced to separate the cables. The winch portion includes a motor, a gear box, a drum and a brake. The brake includes a ratchet and two brake disks. It uses at least one friction surface that contacts at least one of the brake disks to cause a pawl to engage or disengage from the ratchet.

4 Claims, 5 Drawing Sheets

U.S. PATENT DOCUMENTS

| | | | | |
|---|---|---|---|---|
| 5,361,565 | A | 11/1994 | Bayer | |
| 5,452,201 | A | 9/1995 | Pieronek et al. | |
| 5,634,628 | A | 6/1997 | Schuch | |
| 5,728,953 | A | 3/1998 | Beus et al. | |
| 5,790,407 | A | 8/1998 | Strickland et al. | |
| 5,823,884 | A | 10/1998 | Ager | |
| 5,996,970 | A | 12/1999 | Auerbach | |
| 6,080,981 | A | 6/2000 | Payne | |
| 6,520,485 | B1 | 2/2003 | Soot | |
| 6,634,622 | B1 | 10/2003 | Hoffend, Jr. | |
| 6,691,986 | B2 * | 2/2004 | Hoffend, Jr. | 254/394 |
| 6,889,958 | B2 | 5/2005 | Hoffend, Jr. | |
| 6,988,716 | B2 * | 1/2006 | Hoffend, Jr. | 254/394 |
| 6,997,442 | B2 | 2/2006 | Hoffend, Jr. | |
| 7,293,762 | B2 * | 11/2007 | Hoffend, Jr. | 254/394 |
| 7,484,712 | B2 * | 2/2009 | Hossler | 254/331 |
| 7,562,863 | B2 * | 7/2009 | Kochan et al. | 254/394 |
| 2003/0030045 | A1 | 2/2003 | Hoffend, Jr. | |
| 2003/0111652 | A1 * | 6/2003 | Hoffend, Jr. | 254/331 |

FOREIGN PATENT DOCUMENTS

| | | | |
|---|---|---|---|
| DE | 4204153 | | 8/1993 |
| EP | 0778239 | | 6/1997 |
| EP | 0953539 | | 3/1999 |
| FR | 2676217 | | 5/1991 |
| FR | 2689415 | | 4/1992 |
| GB | 714071 | | 6/1952 |
| GB | 2158032 | A | 11/1985 |
| GB | 2183212 | A | 6/1987 |
| GB | 2271973 | A | 4/1994 |
| GB | 2296481 | | 3/1996 |

* cited by examiner

THEATER RIGGING SYSTEM

CROSS-REFERENCE TO RELATED APPLICATIONS

The present application claims priority to U.S. provisional patent application No. 60/608,811, filed on Sep. 10, 2004, and is a divisional application of U.S. patent application Ser. No. 10/906,348, filed on Feb. 15, 2005; all of the foregoing patent-related document(s) are hereby incorporated by reference herein in their respective entirety(ies).

FIELD OF THE INVENTION

The present invention relates to rigging systems for raising and lowering scenery sets and other items in theaters, and more specifically to a system that allows a winch assembly for raising and lowering theater scenery and other items to be easily repositioned and also provides a winch drum that is easily modifiable for specific installations.

BACKGROUND OF THE INVENTION

Rigging equipment is an essential part of most stages from the middle school level up to major performing arts centers. Rigging allows equipment on the stage to be raised, lowered, rotated and moved from side to side, serving the following functions:

Access to Equipment. The ability to raise and lower the stage lighting and other on stage equipment for adjustment, replacement of lamps and gels, and for maintenance is essential. Lighting equipment is frequently moved to meet the requirements of individual productions. All of these functions are most easily performed when the battens are brought to the floor level, rather than working off of ladders.

Masking of Equipment. Curtains are used to mask equipment from audience view. In many cases the height of the masking curtains will need to change to meet the requirements of specific productions. The ability to raise and lower the curtains easily is important.

Dramatic Effect. For many theatres, the primary use of the rigging equipment is to move scenery for dramatic effect. Not only does a well designed rigging system allow for simple, easy scene changes, many shows require that scenery move in front of the audience. This adds drama, and can be a key part of any production.

Counterweight rigging systems are the traditional method of raising and lowering stage equipment and consist of one or more rigging sets. A simple, manual counterweight set consists of a balanced system of weights and pulleys by which loads such as scenery, curtains, or lighting equipment can be raised and lowered. Each set is comprised of a load batten suspended from lift lines that pass over loft block sheaves, then over a head block at one side of the stage, and finally down to a counterweight arbor. The arbor holds weights that are adjusted by the user to balance (or counterweight) the load. Movement of the set is controlled by a rope hand line that passes from the top of the arbor, over the head block, down through a rope lock mounted on the locking rail, around a tensioning floor block and back to the bottom of the arbor.

While manually operated counterweight systems are economical to purchase and install, motorized rigging equipment is becoming more popular in new installations at all levels, from high schools to opera houses. The motorized rigging sets used on stage are generally "dead haul" sets, where the motor lifts the entire weight of the equipment without the use of counterweights. This eliminates the need for keeping sets balanced and addresses the safety concerns that come with improperly-balanced counterweight sets. The sets are operated using control systems ranging from simple pushbutton panels to sophisticated computer systems with the ability to record and play back cues.

Motorized rigging sets generally are easier to install and use than counterweight sets. Motorized winches are available in a wide range of speeds, capacities, types, and costs. Winches can be designed and built to meet a particular venue's specific requirements. Fixed speed winches are generally used for heavy loads which do not have to move dynamically in front of an audience. Examples include lighting battens, speaker clusters, and orchestra shell ceilings. The tremendous speed range possible with variable speed winches makes them ideal for use with scenery that must move in front of the audience. A winch that performs a subtle move at rate of less than a foot per minute can suddenly travel at several hundred feet per minute in the next cue.

The most widely used motorized winch has a single drum long enough to accommodate all of the lift lines required for the set. The drum is helically grooved so that the lift lines wrap neatly in a single layer, to avoid damage to the lift lines (which generally consist of wire rope) and to keep all lines lifting evenly. Winches can be located on the grid, galleries, or in a separate motor room. Head and loft blocks may be used to route the lift lines to the batten.

Traveling drum winches are built so that the drum translates or moves axially as it turns, keeping the point where the wire rope leaves the drum constant. Also known as zero fleet angle winches, these work well when there is very little distance between the drum and the head block. Typically, such winches include an acme screw or a ball screw that turns with the winch drum and engages a nut to cause the drum to translate axially.

It is known to provide modular assemblies that include a winch and a head block. Such assemblies, however, usually are mounted directly to structural support members (e.g., load bearing beams) in a theater or other venue in which rigging systems are used, and cannot be moved easily or adjusted. If the structural members of the theater are not located in locations suitable for mounting the winch and head block, it is necessary to move the structural support members or to offset the mounting of the winch and head block. Either of these options is an expensive and complicated process.

Typical winch assemblies use winch drums that have a standard length or that are custom manufactured to fit a specific application. Standard length winch drums may not be the ideal size for certain applications, while custom manufactured drums may be too expensive.

Typical rigging systems in which the winch and head block form a modular assembly require the entire winch portion to translate axially as lines wind and unwind on the drum. Where the rigging system is installed vertically, this requires the entire winch assembly to work against gravity in one direction of travel. Because the motor and gearbox are the heaviest components of the winch assembly, this imposes demands on the axial drive mechanism that would be unnecessary if the drum portion of the winch assembly could translate separately.

When a conventional rigging system is installed horizontally (the predominant installation), the drum generally must be supported by a bearing that is separate from the nut that engages the translating screw. When the nut also functions as a bearing to support the drum, the vertical forces exerted on the translating screw cause binding of the thread engagement between the translating screw and the nut.

Finally, some winch and head block assemblies known in the art use overly complicated or unreliable brake assemblies. Because such assemblies often support the entire dead weight of theater loads, including curtains, set backdrops, lights and/or other items, it is important that they incorporate reliable brake mechanisms to prevent unintentional and uncontrolled descent of a load. In one assembly known in the art, the brake mechanism includes a solenoid that activates a pawl when an uncontrolled condition is electronically sensed. Such a system does not account for failure of the electronic sensing system and would therefore be an inadequate brake if the electronic sensing system were to fail.

What is needed is a theater rigging system that can easily be attached to structural members of a theater or other venue in which theater rigging is required.

What is further needed is a theater rigging system that incorporates an easily adjustable winch assembly and head block.

What is further needed is a theater rigging system that incorporates an easily customizable winch drum, allows the winch drum to translate independent of the motor and gearbox.

What is also needed is a theater rigging system that incorporates a winch a with a simple, but reliable brake to prevent unintentional and uncontrolled descent of a theater load.

It is therefore an object and advantage of the present invention to provide a theater rigging system that can easily be attached to structural support members of a theater or other venue in which theater rigging is required.

It is a further objective and advantage of the present invention to provide a theater rigging system that includes a winch assembly and head block that can easily be positioned at a variety of positions with respect to the structural support members of a theater or other venue in which theater rigging is required, and once positioned, can easily be fixed in place, and additionally can easily be sized to fit a wide variety of applications.

It is a further objective and advantage of the present invention to provide a winch drum that can be customized for a variety of applications and that translates axially independent of the winch motor and axle.

It is yet a further objective and advantage of the present invention to provide a theater rigging system that includes a winch assembly and head block with a simple but reliable brake that prevents unintentional and uncontrolled descent of theater loads.

SUMMARY OF THE INVENTION

In accordance with the foregoing objects and advantages, the present invention provides a theater rigging system comprising a beam for attachment to the structural members of a theater or other venue. According to one embodiment, the beam comprises at least one T-slot along its longitudinal axis. According to another embodiment, the beam consists of a conventional I-beam. Also provided is a winch assembly and head block with at least one head sheave, the head block having T-slot fittings that correspond with the T-slot of the beam, allowing the head block to be positioned at any location along the length of the beam, which T-slot fittings can be selectively secured to fix the head block in position relative to the beam. According to one embodiment, the winch drum is modular and its length can easily be modified for it to be used with variable number of cables. Threads associated with the drum cause it to translate axially as it rotates. The winch has a Weston-style brake to prevent unintentional and uncontrolled descent of loads, the pawl of the Weston style brake having a friction mechanism to move the pawl into and out of engagement with the brake's ratchet wheel.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
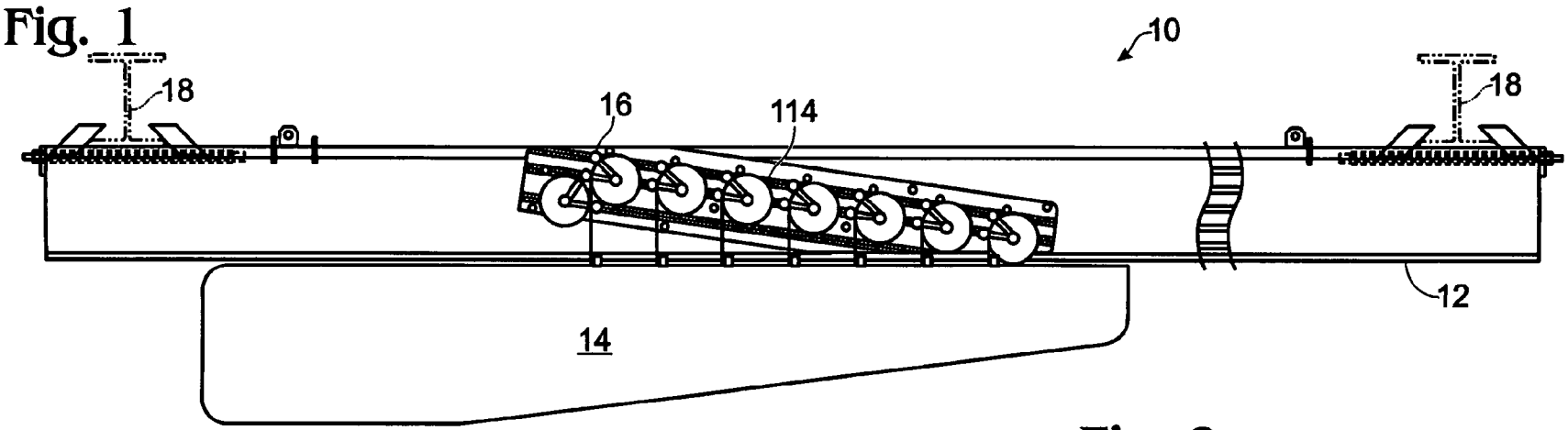
FIG. 1 is a side elevation view of a lift assembly installed in a building.

Referring now to the drawings, wherein like reference numerals refer to like parts throughout, there is seen in FIG. 1 a theater rigging system 10 according to the present invention, comprising a beam 12, a winch assembly 14, and a head block 16.

Beam

Figure 2B:
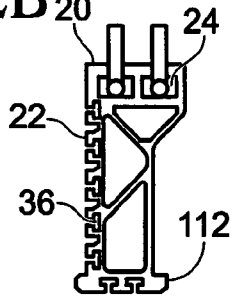
FIG. 2B is an end elevation view of the beam in FIG. 2.
Figure 2:
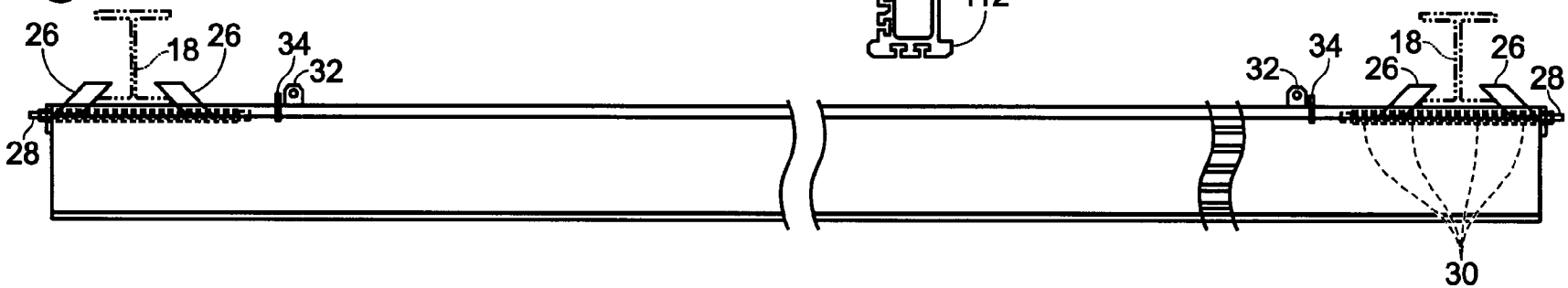
FIG. 2 is a side elevation view of a beam.

The beam 12 is attached to structural support members 18 that are part of the building or structure in which the rigging system 10 is installed. Referring now to FIGS. 2 and 2B, there is seen a beam 12 according to an embodiment of the present invention. The beam 12 can be formed of a variety of materials, depending on the requirements of a specific facility's installation. Some materials that have been found acceptable include aluminum, steel, their alloys and carbon fiber. Preferably, the beam 12 is approximately one foot high and six inches wide. Those skilled in the art will recognize that other dimensions are also suitable for this invention and are intended to be included within the scope of this disclosure. The length of the beam 12 varies, depending on the facility in which it is to be installed.

The beam 12 has an upper surface 20 and a lateral surface 22. In one embodiment, the upper surface 20 of the beam 12 includes at least one upper track 24. According to one embodiment, the beam 12 is formed as an extrusion, which reduces machining costs. The beam 12 is attached to structural support members 18 using adjustable mounting clamps 26. Mounting clamps 26 may be positioned in the upper track 24. A flange on each mounting clamp 26 engages the upper track 24, allowing the mounting clamp 26 to slide along the upper track 24. Each pair of mounting clamps 26 is positioned in the upper track 24 such that the jaw of one mounting clamp 26 faces the jaw of a second mounting clamp 26. Each pair of mounting clamps 26 is positioned to engage structural support members 18. Each mounting clamp 26 has a hole, the axis of which is parallel to the axis of the upper track 24 when the mounting clamp is positioned in the upper track 24. An adjusting bolt 28 passes through the hole of each pair of mounting clamps 26, through two exterior floating nuts 30, and through two interior floating nuts 30. To engage structural support members 18, the adjusting bolt 28 is tightened to draw the exterior floating nuts 30 together, which in turn draws the mounting clamps 26 to each other, causing each pair of mounting clamps 26 to grip a structural support member 18. If it is necessary to remove the beam 12, the adjusting bolt 28 is loosened, forcing the interior floating nuts 30 apart, which in turn forces the mounting clamps 26 apart.

Lifting shackles 32 may be positioned along the upper surface 20 of the beam 12 to assist in lifting the beam 12 into place for installation. A flange on each lifting shackle 32 engages the upper track 24, allowing the lifting shackle to slide along the upper track 24. Preferably, there are two upper tracks 24 on the upper surface 20 of the beam 12. Each lifting shackle 32 may be selectively fixed in position in its associated upper track 24 by use of a set nut 34. The beam's lateral surface 22 includes at least one T-slot 36 for attaching other components of the rigging system 10.

Figure 9:
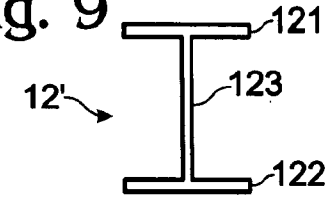
FIG. 9 is an end elevation view of a beam according to an embodiment of the invention.

In an alternate embodiment, beam 12' (FIG. 9) is a conventional steel I-beam, having an upper flange 121 a lower flange 122 and a web 123. According to this embodiment, certain components of the theater rigging system 10, for example the headblock 16, are fixedly attached to the web 123 of beam 12' by means of bolts instead of using T-slots and T-slot fittings as described below. According to this embodiment, other components of the theater rigging system 10, for example the winch assembly 14, are slidably attached to the flanges 121, 122 of the beam 12', in the same manner as described below.

Winch Assembly

Figure 3A:
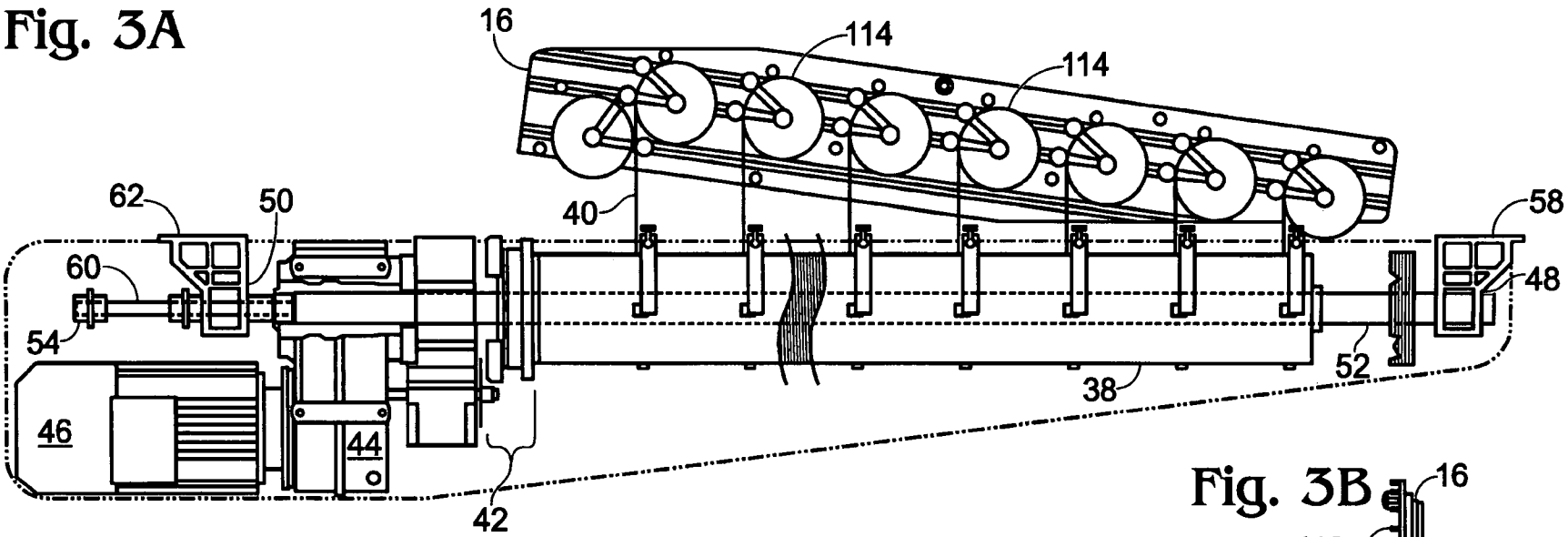
FIG. 3A is a sectional side elevation view of a winch assembly and head block according to an embodiment of the invention.
Figure 3B:
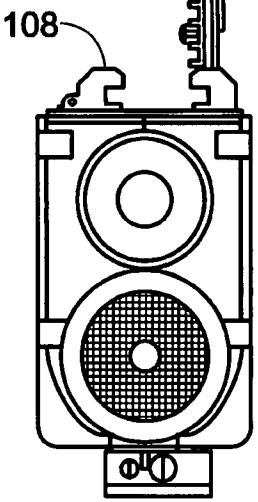
FIG. 3B is an end elevation view of a winch assembly and head block according to an embodiment of the invention.

Referring now to FIGS. 3A and 3B there is seen a winch assembly 14 according to an embodiment of the present invention. The winch assembly 14, further comprises a drum 38, one or more cables 40, a brake 42, a gearbox 44, and a motor 46. The winch assembly 14 is mounted to the beam 12 by means of a first tailstock 58, having a smooth bearing 48, on one end of the winch assembly 14 and a second tailstock 62, having a threaded bearing 50, on the other end of the winch assembly 14. The axle 52 rests in the smooth bearing 48 and has a screw portion at its first end 54 that engages and rests in the threaded bearing 50. As the axle 52 turns to wind and unwind cables 40, the engagement of the axle's threads in the threaded bearing 50 causes the axle 52, drum 38, brake 42, gearbox 44, and motor 46 to translate along the axis of the drum 38, maintaining the fleet angle of the cables 40 as they leave the drum 38.

According to one embodiment, the axle 52 preferably engages a gearbox 44. The axle 52 may be comprised of a single piece or may be comprised of multiple pieces joined together. The second end 56 of the axle 52 extends through the drum 38 and engages a first tailstock 58, preferably including a fixed bearing. The axle's first end 54 extends through the gearbox 44. The axle's first end 54 comprises a screw portion 60, which may be integral to the axle 52 or may be a connected component. The screw portion 60 passes through second tailstock 62, which is fixed in position relative to the beam 12 and head block 16 and contains a threaded bearing 50. According to this embodiment, by means of the screw portion 60, the axle 52, drum 38, motor 46 and gear box 44 move along the drum's longitudinal axis as it rotates. In this way, the helix angle formed by the cables 40 as they wind and unwind from the drum 38 remains at 90°.

Figure 4B:
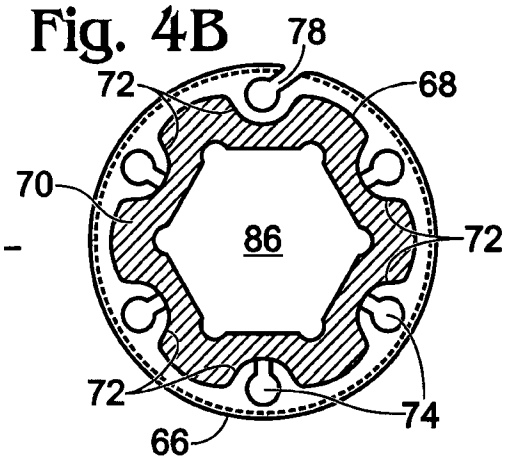
FIG. 4B is an end elevation view of a drum module and drive shaft.
Figure 4A:
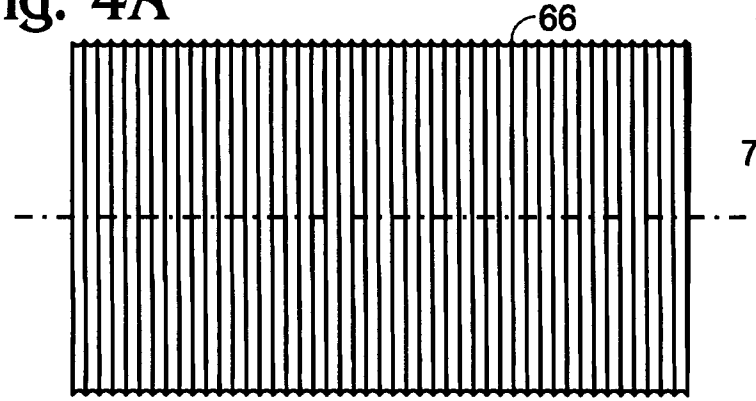
FIG. 4A is a side elevation view of a drum module.
Figure 5:
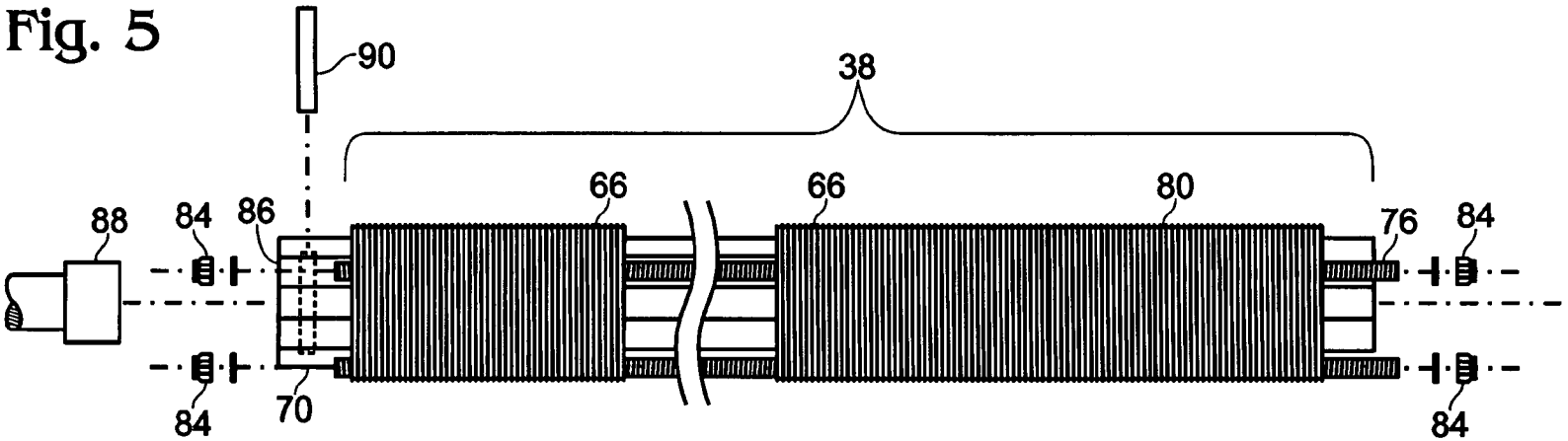
FIG. 5 is an exploded side view of the drum portion of a winch assembly.

Turning now to FIGS. 4A, 4B and 5, in another embodiment of the invention, the drum 38 is comprised of a plurality of modules. Each drum module 66 is approximately 5 ½" in diameter, 10" in length and ¼" in thickness. Those skilled in the art will recognize that drum modules 66 having other dimensions are within the scope of this disclosure. Drum modules 66 can be manufactured with different diameters and lengths to accommodate requirements of specific installations. Each drum module 66 is hollow, forming an interior bore 68 for receiving a drive shaft 70. Drum modules 66 are preferably formed by extrusion, which results in reduced weight, and requires fewer machining steps. Drum modules 66 may also be formed by molding and other techniques known in the art. In a preferred embodiment, the interior bore 68 of drum modules 66 includes six projections 72, at least three of which include a closed channel 74 that is parallel to the axis of the drum 38 and which is sized to accept a threaded rod 76. Another of the projections 72 includes an open channel 78 that is open to the outer circumference of drum module 66. This open channel 78 is for accepting a fitting to attach a cable 40 the drum 38. A notch for attaching cable 40 can be substituted for open channel 78.

The length of the drum 38 is determined by the number and length of cables 40 in the assembly 10. Each drum module 66 preferably is sized to contain all or a portion of a single cable 40 when cables 40 are completely wound onto drum 38. Alternatively, drum modules 66 can be sized to accommodate a plurality of cables 40. The drum 38 comprises at least one drum module 66, a drum drive module 80, a plurality of threaded rods 76, and a drive shaft 70. The drum drive module 80 is similar in size and shape to the drum modules 66. According to one embodiment, the drum drive module 80 has threads formed on its outer surface for engaging a floating nut 82 to cause the drum assembly to translate along its axis. The floating nut 82 acts as a bearing while the drum 38 translates (see below). The drum module(s) 66 and drum drive module 80 are joined together using rods 76 that pass through closed channels 74 in each of the drum module(s) 66 and drum drive module 80. The rods 76 are threaded on their ends and nuts 84 are used to attach drum modules 66 and drum drive modules 80 securely together.

The exterior surface of each drum module 66 is helically contoured to allow the cable 40 to lie in one layer when it is wound onto the drum module 66. Each drum module 66 includes an attachment point for a cable 40. Drum modules 66 can be made from a variety of materials including aluminum, steel, their alloys, plastics, polymers, carbon fiber or other materials that are capable of being fashioned into a light and rigid module. According to one embodiment of the invention, the helical contours on the surface of the drum drive module 80 can serve as threads to engage the floating nut 82 and drive the axial translation of the drum 38.

Figure 8:
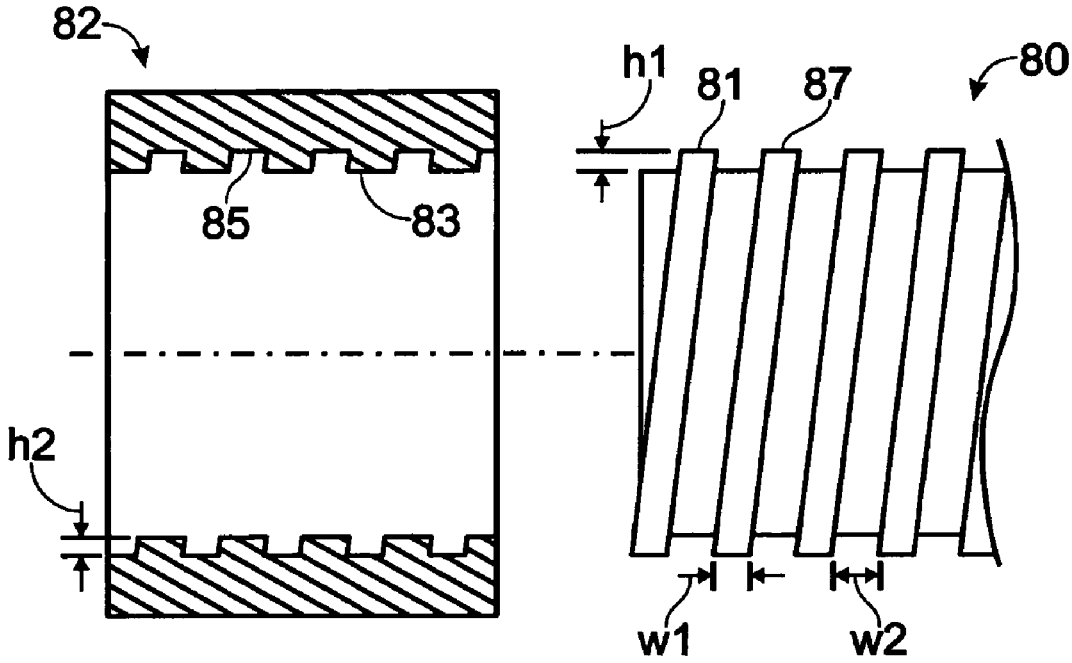
FIG. 8 is an exploded, partial sectional side elevation view of a fixed nut and drum drive module according to an embodiment of the present invention.

According to an embodiment of the invention, the drum drive module 80 comprises first threads 81 that engage second threads 83 formed in the floating nut 82. To prevent binding between the first threads 81 and second threads 83 when there is a substantial force component perpendicular to the axis of the drum 38, the first threads 81 and second threads 83 are specially shaped as seen in FIG. 8. Preferably first threads 81 and second threads 83 are square cut with a minor radius at the corners of the threads. The width w1 of the threads is slightly smaller than the width w2 of the channel between the threads. Preferably the threads are approximately 0.090 inches wide and the channel between threads is approximately 0.110 inches wide. On floating nut 80, preferably the width w3 of the channel between second threads 83 and the width w4 of second threads 83 is approximately 0.100 inches. Other dimensions are also within the scope of this disclosure and will be known to those skilled in the art. There is a slight difference in the height h1 of first threads 81 and the height h2 of second threads 83. Preferably, first threads 81 are 0.030 inches higher than second threads 83. Because of the difference in height, the primary engagement surfaces are the channel floor 87 of second threads 83 and the outer diameter 85 of the first threads 81.

Figure 6:
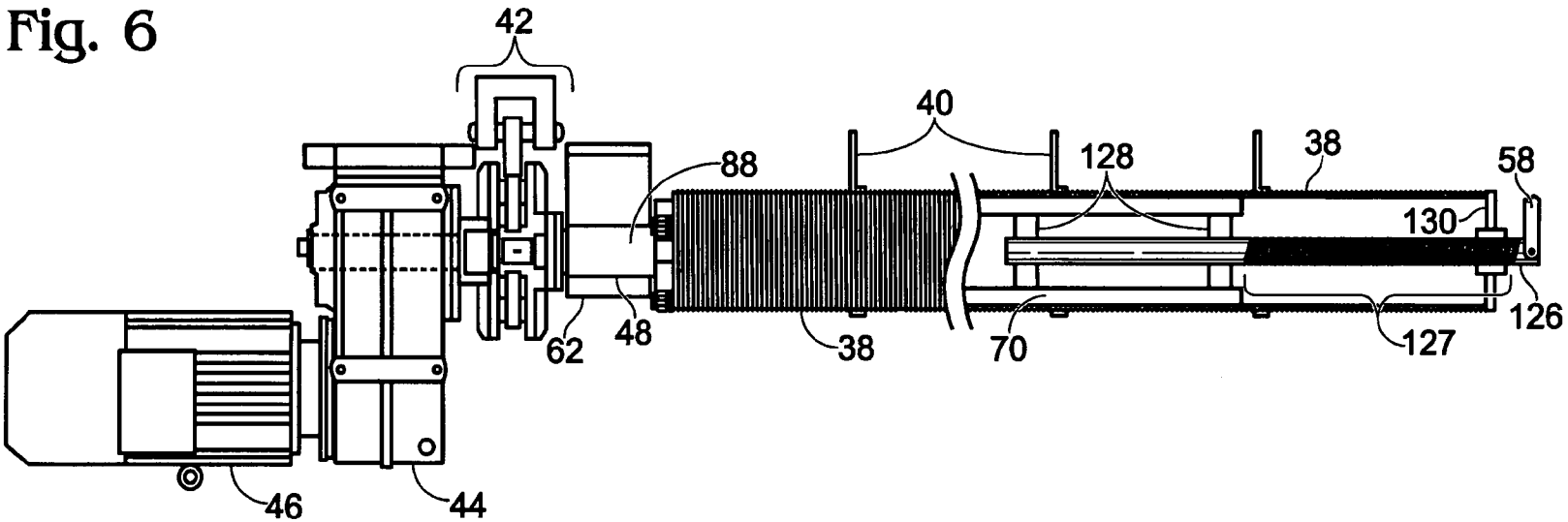
FIG. 6 is a side elevation view of the winch assembly according to one embodiment of the present invention.

According to another embodiment of the invention (FIG. 6), drum 38 is axially driven by a partially threaded rod 126 that is non-rotatably connected to first tailstock 58, for example using a pin. The partially threaded rod 126 rests partially within the drive shaft 70, supported within drive shaft 70 by one or more bearings 128. The partially threaded rod 126 includes a threaded portion 127 that is at least as long as a drum module 66. The threaded portion 127 of the partially threaded rod 126 engages a threaded nut 130 that is fixed in position and non-rotatable relative to drum 38. Engagement of the partially threaded rod 126 and the threaded nut 130 causes the drum 38 to translate relative to the partially threaded rod 126 as drum 38 rotates. According to this embodiment, the brake 42, gearbox 44 and motor 46 do not translate.

Referring now to FIGS. 4B and 5, the drive shaft 70 is sized to fit within the interior bore 68 of the drum modules 66 such that the drive shaft 70 slides freely along the axis of the drum 38. The drive shaft 70 is shaped to engage the projections 72 on the interior bore 68 of the drum modules 66. The length of the drive shaft 70 is determined by the number of drum modules 66 and drum drive modules 80 to be used in the drum 38. The drive shaft 70 preferably is at least long enough that it continues to engage all of the drum modules 66 and the drum drive module 80 when the drum 38 has reached the limit of its axial translation. Generally, this means that the drive shaft 70 must have a length that is at least as long as the drum 38 plus the length of a single drum module 66. Preferably, the drive shaft 70 is formed of extruded aluminum and is hollow, but it may also be fashioned of other materials familiar to those skilled in the art and may also be machined or molded.

The interior of the drive shaft 70 forms a drive socket 86 for engaging a stub shaft 88. The drive socket 86 is preferably hexagonal in shape, but other shapes, such as square, triangle, pentagon or others are also acceptable, provided they engage projections 72 on the interior bore of the drum 38 and freely slide along the axis of the drum 38. The stub shaft 88 is connected to the drive shaft 70 by means of a pin 90 that passes through the drive shaft 70 and into the stub shaft 88. Other connection means are known to those skilled in the art. The stub shaft 88 engages a similar socket formed in first brake disk 92, and is connected to first brake disk 92 by a pin 90 that passes through a portion of first brake disk 92 and into stub shaft 88.

Figure 7:
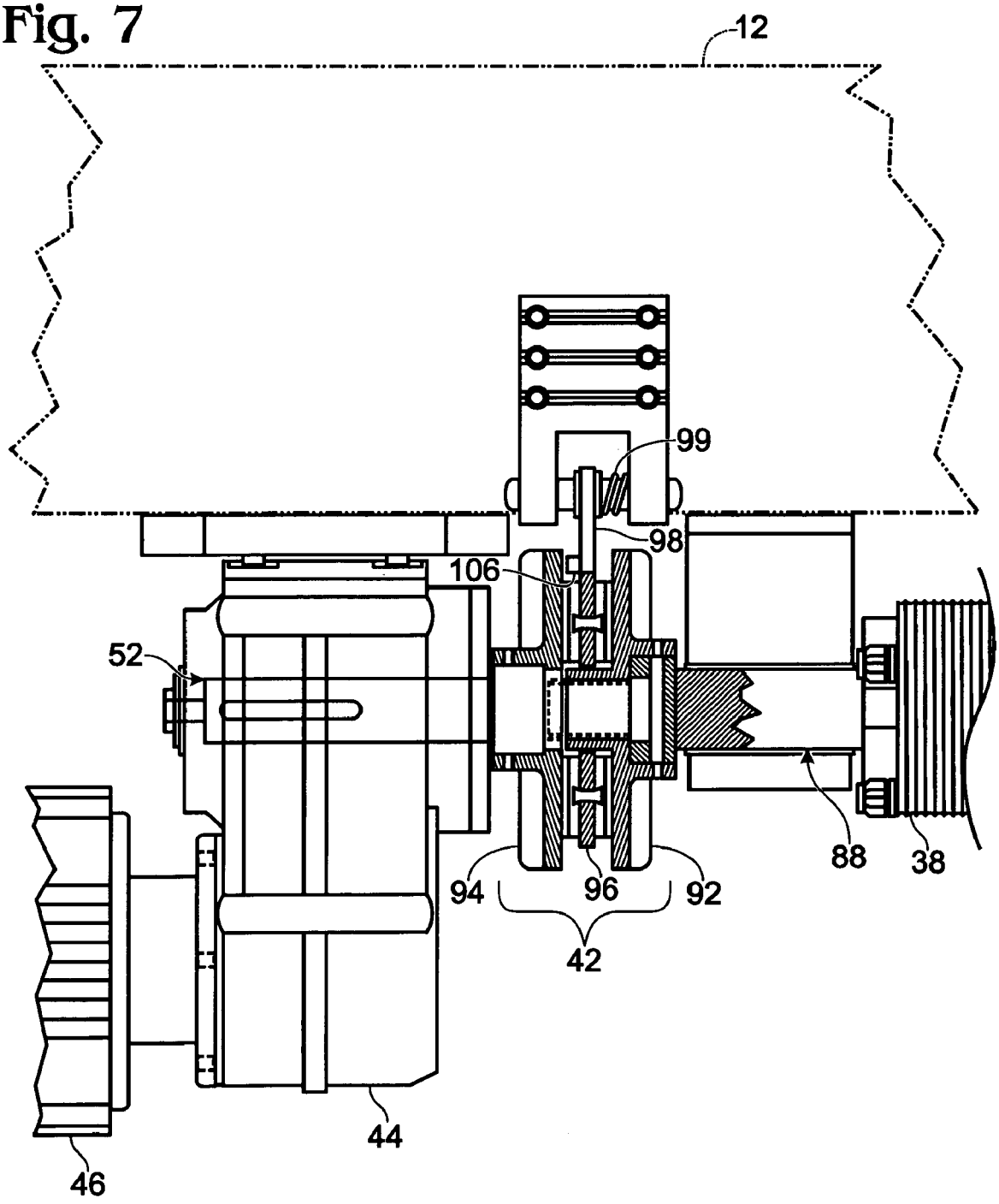
FIG. 7 is a side elevation view of a winch brake according to one embodiment of the present invention.

The winch assembly 14 includes a brake 42. The brake 42 is preferably a Weston-style brake. Referring to FIG. 7, there is seen a brake assembly according to one embodiment of the invention, having a first brake disk 92, a second brake disk 94, a ratchet wheel 96, and a pawl 98. The first brake disk 92 is fixedly connected to the drum 38 and/or stub shaft 88. The second brake disk 94 is fixedly connected to the axle 52. The ratchet wheel 96 is positioned around the axle 52, between the first brake disk 92 and the second brake disk 94. The ratchet wheel 96 can freely rotate about the axle 52. The perimeter of the ratchet wheel 96 is composed of ratchet teeth. Threaded portions connected to the first brake disk 92 and the second brake disk 94 either draw the respective brake disk 92, 94 together or force them apart, as is described in more detail below.

The pawl 98 is rotatably attached to the winch assembly 14. Alternatively, the pawl 98 may be rotatably attached directly to the beam 12 and aligned to engage the ratchet wheel 96. When in its engaged position, the pawl 98 engages a tooth on the ratchet wheel 96, preventing the ratchet wheel 96 from rotating. When in its disengaged position, the pawl 98 has no effect on the ratchet wheel 96 and the ratchet wheel 96 can turn without restriction by the pawl 98. The pawl 98 includes at least one friction surface for contacting at least one of said first brake disk 92 and said second brake disk 94.

In one embodiment, the friction surface comprises a contact pad 106 on a first side of the pawl 98. According to this embodiment, the pawl 98 is biased so that the contact pad 106 is urged into contact with either of the first brake disk 92 or the second brake disk 94. The contact pad 106 preferably is attached to the pawl 98 in such a way that it can be replaced after it wears sufficiently to be inoperative. The method of attachment will vary with the material of which the contact pad 106 is constructed. According to this embodiment the contact pad 106 can be any material that provides sufficient friction between the contact pad 106 and the brake disk 92, 94 to cause the pawl 98 to rotate into or out of position as described below. Preferably, the contact pad 106 material should also be sufficiently durable that it will not require frequent replacement and it should also be resistant to the heat generated by the constant friction between the contact pad 106 and the brake disk 92, 94. The following materials have been found to be acceptable: wood, polymers or their composites. Those skilled in the art will recognize that other materials will also be acceptable and fall within the scope of this disclosure.

Figure 10:
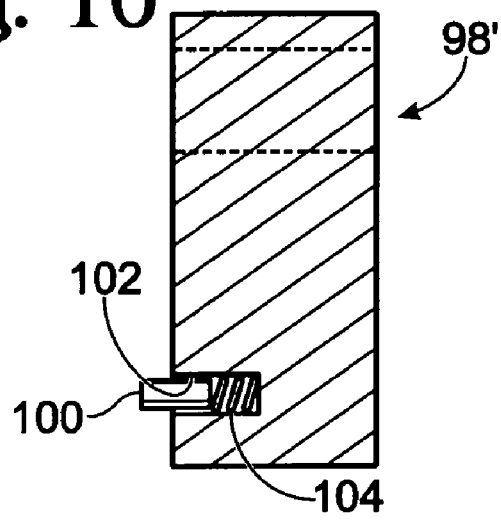
FIG. 10 is a side elevation view of a pawl used in a winch brake according to one embodiment of the present invention.

In another embodiment (FIG. 10) the friction surface comprises at least one friction disk 100. Each friction disk 100 slides freely in a friction disk bore 102 formed in the pawl 98'. Friction disk 100 is outwardly biased by an internal spring 104 causing it to contact one of the first brake disk 92 or the second brake disk 94. In one embodiment, friction disk 100 is made of wood. A variety of other material is acceptable for friction disk 100, provided that it is durable, generates sufficient friction to cause the pawl 98 to rotate in and out of engagement with the ratchet wheel 96, does not make substantial noise when sliding against the brake disks 92, 94 and will slide easily in the friction disk bore 102. For installations in which humidity is variable, it is necessary to select material for the friction disk 100 that will not be affected by variations in humidity.

When cable 40 is being wound onto the drum 38, second brake disk 94 is driven by the gearbox 44 (or motor 46). First brake disk 92 does not turn until a threaded portion connected to first brake disk 92 turns sufficiently far into a threaded portion connected to second brake disk 94 that the ratchet wheel 96 is compressed between the first brake disk 92 and the second brake disk 94. When this occurs, the drum 38 begins to turn with the axle 52 and the cable 40 is wound onto the drum 38. Contact pad 106 is urged into contact with brake disk 94, the rotation of which causes pawl 98 to rotate out of engagement with ratchet wheel 96, thereby allowing rotation of the drum 38 without noise from the ratchet wheel 96 and pawl 98. According to an alternate embodiment, friction disk 100 contacts the first brake disk 92 and/or second brake disk 94, the rotation of which cause the pawl 98' to rotate out of engagement with the ratchet wheel 96, thereby allowing rotation of the drum 38 without noise from the ratchet wheel 96 and pawl 98'.

When cable 40 is being unwound from the drum 38, second brake disk 94 turns with the gearbox 44 (or motor 46). Friction disk 100 or contact pad 106 contacts the rotating second brake disk 94, which causes pawl 98 to engage the teeth of ratchet wheel 96. This prevents further rotation of the ratchet wheel 96. Rotation of second brake disk 94 without corresponding rotation of first brake disk 92 causes the threaded portion connected to first brake disk 92 to unscrew from the threaded portion connected to second brake disk 94. This increases space between the first brake disk 92 and second brake disk 94, eliminating compression of the ratchet wheel 96 and allowing first brake disk 92 (and the drum 38) to rotate in an unwinding direction. When second brake disk 94 stops rotating in an unwinding direction, the load on the drum 38 causes the drum 38 and second brake disk 94 briefly to continue rotating in an unwinding direction. This causes the threaded portion connected to first brake disk 92 to screw into the threaded portion connected to second brake disk 94, once again causing compression of the ratchet wheel 96 between the first brake disk 92 and the second brake disk 94, which causes the drum 38 to stop rotation in an unwinding direction.

Preferably, the brake 42 includes two pawls 98 positioned at different positions around the ratchet wheel 96. Preferably the pawls 98 are offset from each other by the angle that is ½ of the tooth angle of the ratchet wheel 96. In this way, the ratchet wheel 96 has twice as many stopping points as there are ratchet teeth.

Referring now to FIG. 3B, there is seen a rail glide 108 and a plurality of T-slot fittings 110. The rail glide 108 supports the winch assembly 14 as it translates along the axis of the drum 38 during winding and unwinding of the drum 38. The rail glide is shaped to rest on and slide freely along a lip 112 formed on the bottom edge of the beam 12. The T-slot fittings 110 engage the T-slots 36 in the beam 12 and secure the head block 16 to the beam 12. Once the head block 16 is positioned on beam 12, the T-slot fittings 110 are secured so that the head block 16 is fixed in position relative to the beam 12. Alternatively, the head block 16 may be fixed in position on beam 12 using pins or self-drilling screws.

Head Block

The head block 16 comprises one or more head sheaves 114. The number of head sheaves 114 on the head block 16 corresponds to the number of cables 40, which will be determined by the application in which the rigging assembly 10 is being installed. Typically, battens require at least one lift point every 10 feet. Thus, a batten that is 50 long would require 6 lift points, which in turn would require 6 cables. According to one embodiment, the head block 16 is attached to the beam 12 by means of T-slot fittings 110 that engage one or more T-slots 36 in the lateral surface 22 of the beam 12.

When installed in the winch, each cable 40 passes from the drum 38 over a head sheave 114 and is redirected generally along the long axis of the beam 12. When head block 16 comprises two or more head sheaves 114, one or more of the head sheaves can be positioned so that their cables 40 are redirected to the end of the winch assembly 14 that does not contain the motor 46. The remaining cable(s) 40 is redirected along the axis of the beam 12, generally in the direction of the end of the winch assembly 14 that contains the motor 46.

When multiple cables 40 exit the head block 16 in the same general direction, the head sheaves 114 over which those cables 40 pass are in the same plane and aligned diagonally as seen in FIG. 1. In this way, the cables are separated from one another as they leave the head block 16. The head sheaves 114 are for changing the direction of the cables 40. Generally, a cable 40 runs from the drum 38, over a head sheave 114 and then to a loft sheave (not shown), where it is redirected again and then is connected to a batten or other load. In a typical configuration, the head sheaves 114 redirect the cables 40 into paths that are generally parallel to the beam 12. Because of the diagonal orientation of the head sheaves 114 on the head block 16, the cable paths are vertically separated. Loft sheaves can be attached to the beam 12 or may be positioned above the level of the head block 16.

The beam 12 to which the winch assembly 14 and head block 16 are attached typically is installed horizontally, but it can also be installed in a vertical position or any other angle necessary to meet the requirements of a specific installation. If the beam 12 is mounted other than horizontally, those skilled in the art will recognize that additional loft sheaves may be required to redirect the path of the cables 40.

While there has been illustrated and described what are at present considered to be preferred and alternate embodiments of the present invention, it should be understood and appreciated that modifications may be made by those skilled in the art, and that the appended claims encompass all such modifications that fall within the full spirit and scope of the present invention.

What is claimed is:

1. A lift system for winding and unwinding at least one cable, the lift system comprising:

a motor assembly;

a head block;

drive shaft defining a central axis and an axial direction, with the drive shaft being operatively connected to the motor assembly so that operation of the motor assembly will cause the drive shaft to rotate about its central axis, and so that the drive shaft does not move with respect to the motor assembly in the axial direction; and a winch drum is constrained to the drive shaft so that:

(i) rotation of the drive shaft about its central axis will drive the winch drum to rotate about the central axis of the drive shaft, and (ii) the winch drum can slide over the drive shaft in the axial direction so that a fleet angle of the cable between the head block and the drum is maintained to be at least substantially constant as the winch drum is driven to rotate.

2. The system of claim 1 wherein:

the drive shaft comprises a winch drum interface surface; and the winch drum comprises a drive shaft interface surface shaped and located to mechanically engage the winch drum interface surface so that rotation of the drive shaft drives the winch drum to rotate through the mechanical engagement of the winch drum interface surface and the drive shaft interface surface.

3. The system of claim 2 wherein the winch drum further comprises a helically contoured surface that is dimensioned to receive the cable when it is wound about the winch drum.

4. The system of claim 1 wherein the winch drum comprises a plurality of modular winch drum segments.

* * * * *